US006598913B2

(12) United States Patent
Meinke

(10) Patent No.: US 6,598,913 B2
(45) Date of Patent: Jul. 29, 2003

(54) FLUSH MOTOR VEHICLE DOOR HANDLE

(75) Inventor: Joseph S. Meinke, Gowen, MI (US)

(73) Assignee: ADAC Plastics, Inc., Grand Rapids, MI (US)

( * ) Notice: Subject to any disclaimer, the term of this patent is extended or adjusted under 35 U.S.C. 154(b) by 0 days.

(21) Appl. No.: 09/797,291

(22) Filed: Mar. 1, 2001

(65) Prior Publication Data

US 2002/0121786 A1 Sep. 5, 2002

(51) Int. Cl.[7] ..... E05B 3/00

(52) U.S. Cl. ..... 292/336.3; 292/DIG. 4; 292/DIG. 22; 292/DIG. 31

(58) Field of Search ..... 292/347, 336.3, 292/348, DIG. 31, DIG. 4, DIG. 22; 16/412, 436, 438

(56) References Cited

U.S. PATENT DOCUMENTS

| | | | | | |
|---|---|---|---|---|---|
| 2,496,737 | A | | 2/1950 | McCallik et al. | |
| 3,020,075 | A | * | 2/1962 | Johnstone et al. | 16/412 |
| 3,830,554 | A | * | 8/1974 | Moussaian et al. | 16/412 |
| 3,967,844 | A | * | 7/1976 | Torii et al. | 292/210 |
| 4,318,557 | A | * | 3/1982 | Bourne et al. | 292/113 |
| 4,588,219 | A | * | 5/1986 | Kobayashi et al. | 292/336.3 |
| 4,652,030 | A | | 3/1987 | Streett | |
| 4,792,165 | A | * | 12/1988 | Nishimura | 292/19 |
| 4,895,403 | A | | 1/1990 | Osenkowski | |
| 5,211,436 | A | | 5/1993 | Feder | |
| 5,248,175 | A | | 9/1993 | Burns | |
| 5,369,911 | A | | 12/1994 | Fortunato | |
| 5,556,145 | A | * | 9/1996 | Takasaki | 292/336.3 |
| 5,743,575 | A | * | 4/1998 | McFarland | 16/82 |
| 5,836,638 | A | * | 11/1998 | Slocum | 220/86.2 |
| 5,862,896 | A | * | 1/1999 | Villbrandt et al. | 16/49 |

* cited by examiner

*Primary Examiner*—Anthony Knight
*Assistant Examiner*—Michael J. Kyle
(74) *Attorney, Agent, or Firm*—Young & Basile P.C.

(57) ABSTRACT

A motor vehicle door handle assembly, including a face plate positioned flush with the door outer surface. When operator pressure is applied to the face plate, the face plate pops out under spring pressure to a position where it may be gripped by the operator and pulled outwardly to unlatch the door and allow opening of the door. When the face plate is thereafter released, the face plate is returned to its flush position in the door by a damper mechanism which overcomes the face plate spring during the return movement of the door handle to return the face plate to its flush position.

25 Claims, 6 Drawing Sheets

FIG - 1
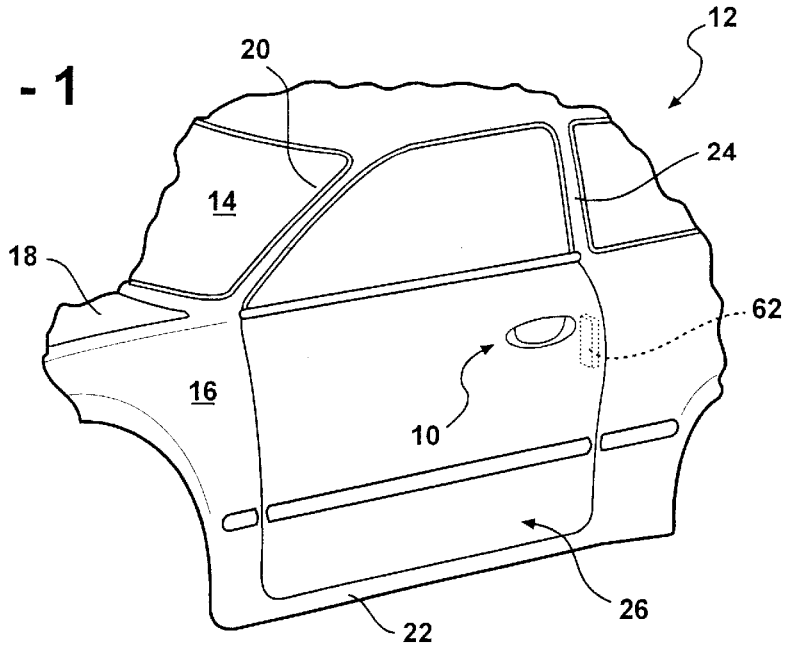
FIG - 2
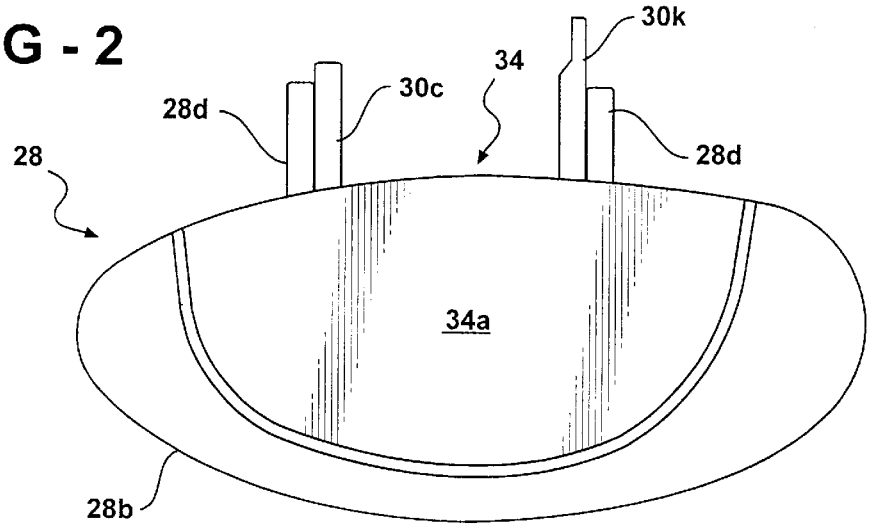
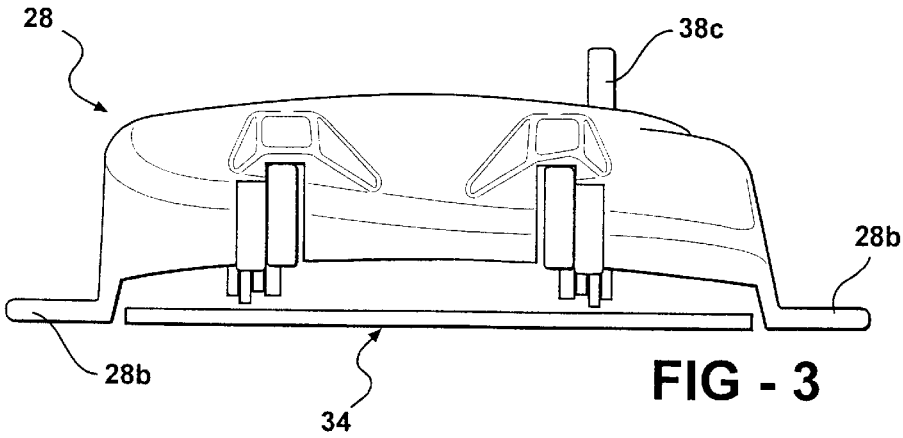
FIG - 3

FLUSH MOTOR VEHICLE DOOR HANDLE

BACKGROUND OF THE INVENTION

1. Field of the Invention

This invention relates to door handle assemblies and more particularly to door handle assemblies especially suitable for use with motor vehicles.

2. Description of the Art

A myriad of designs have been proposed and/or utilized for use as door handle assemblies for motor vehicles. Whereas these designs have been generally satisfactory, they have suffered from one or more disadvantages. Specifically, either the door handle has disturbed the otherwise smooth outer surface of the door, resulting in poor aesthetics, wind noise and wind resistence, or the door handle, if flush with the outer door surface, has been awkward to operate.

SUMMARY OF THE INVENTION

This invention is directed to an improved motor vehicle door handle assembly.

More specifically, this invention is directed to a motor vehicle door handle assembly that is totally flush with the outer door surface and is easy to operate.

The invention handle assembly is for use with a motor vehicle door having a panel defining an opening.

According to the invention, the assembly includes a face plate sized to fit in and fill the opening; a mounting structure mounting the face plate in the door panel for movement between a flush position in which an outer surface of the face plate presents substantially flush with the door panel and substantially fills the opening, and a grip position in which the face plate is displaced outwardly from the door panel and defines a finger access space between the face plate and the opening; and means operative in response to inward pressure applied to the face plate with the face plate in the flush position to move the face plate outwardly from the flush position to the grip position. This arrangement provides a flush door handle design that is easily operated.

According to a further feature of the invention, the mounting structure further mounts the face plate for inward movement relative to the door panel to a release position, and the operative means is operative in response to inward movement of the face plate to the release position to move the face plate outwardly through the flush position to the grip position. This arrangement allows the door handle assembly to be moved to an operative position by simply pressing on the face plate.

According to a further feature of the invention, the mounting structure comprises a handle base member adapted to be mounted for movement on the door between a latch position and an unlatch position; the face plate is mounted on the handle base member for movement between its flush, grip, and release positions; and the face plate is arranged to move the handle base member from the latch position to the unlatch position in response to further outward displacement of the face plate from the door panel with the face plate in the grip position. This arrangement allows the handle assembly to be readily moved to an unlatch position following movement of the face plate to a grip position.

According to a further feature of the invention, the handle base member is adapted to be pivotally mounted on the door proximate the opening for movement between its latch and unlatch positions, and the face plate is pivotally mounted on the handle base member for movement between its flush, grip, and release positions. This pivotal mounting simplifies and facilitates the operation of the handle assembly.

According to a further feature of the invention, the handle assembly further includes a casing adapted to be fitted into an aperture in the panel and including a rim portion defining the opening in the door panel, and the handle base member is pivotally mounted on the casing. This arrangement allows the use of a casing to facilitate installation and operation of the handle assembly.

According to a further feature of the invention, the operative means comprises a secondary spring means interconnecting the handle base member and the face plate and urging the face plate outwardly from the handle base member to the grip position, and detent means maintaining the face plate in its flush position and operative in response to inward pressure on the face plate to release the face plate from movement to the grip position under the urging of the spring means. This arrangement facilitates and simplifies the movement of the face plate to the grip position.

According to a further feature of the invention, the door handle assembly further includes restoring means operative in response to return movement of the handle base member from the unlatch position to the latch position to move the face plate on the handle base member from the grip position to the flush position. This arrangements ensures that the face plate will be returned to its flush position in the door following each unlatch/latch cycle.

According to a further feature of the invention, the restoring means includes a damper assembly operative during the return movement of the handle base member to apply a resistive force to the face plate greater than and opposing the urging force of the secondary spring means. This arrangement allows the restoring means to move the face plate from the grip position to the flush position during the return movement of the handle base member.

According to a further feature of the invention, the damper assembly includes a damper having a damper pinion and a rack connected to the face plate and meshingly engaging with the damper pinion. This arrangement provides a simple and effective means of operatively interconnecting the face plate and the damper assembly.

According to a further feature of the invention, the damper assembly is operative during the return movement of the handle base member to move the face plate from the grip position inwardly through the flush position to a further stop position, and the rack is arranged to disengage from the damper pinion following movement of the face plate to the stop position and return movement of the handle base member to the latch position. This arrangement allows the secondary spring means to move the face plate from the stop position to the flush position following return movement of the handle assembly to thereby restore the face plate to its flush position within the door panel opening.

According to a further feature of the invention, the damper is mounted on the casing, the face plate is pivotally mounted on the handle base member, and the rack is pivotally connected at one end thereof to the face plate and defines rack teeth proximate another end thereof for meshing co-action with the damper pinion. This arrangement facilitates the packaging and smooth operation of the assembly.

According to a further feature of the invention, the detent means is operative to normally maintain the face plate in its flush position against the urging of the secondary spring means; allows movement of the face plate to the release position against the urging of the secondary spring means in response to inward pressure applied to the face plate with the face plate in the flush position; allows the face plate to move outwardly from the release position to the grip position under the urging of the secondary spring means upon release of the inward pressure on the face plate; allows movement of the handle base member from the latch position to the unlatch position against the urging of the primary spring means in response to outward movement of the face plate with the face plate in the grip position; allows movement of the face plate from the grip position to the stop position in response to the resistive force of the damper assembly upon return movement of the handle base member from the unlatch position to the latch position; and allows movement of the face plate from the stop position to the flush position under the urging of the secondary spring means upon disengagement of the rack from the damper pinion. This specific detent construction defines and coordinates the co-acting movement of the handle base member and the face plate during an unlatch/latch cycle.

BRIEF DESCRIPTION OF THE DRAWING

FIG. 1 is a fragmentary view of a motor vehicle employing a door handle assembly according to the invention;

FIG. 2 is a front view of the door handle assembly;

FIG. 3 is a top view of the door handle assembly;

DETAILED DESCRIPTION OF THE PREFERRED EMBODIMENT

Figure 4:
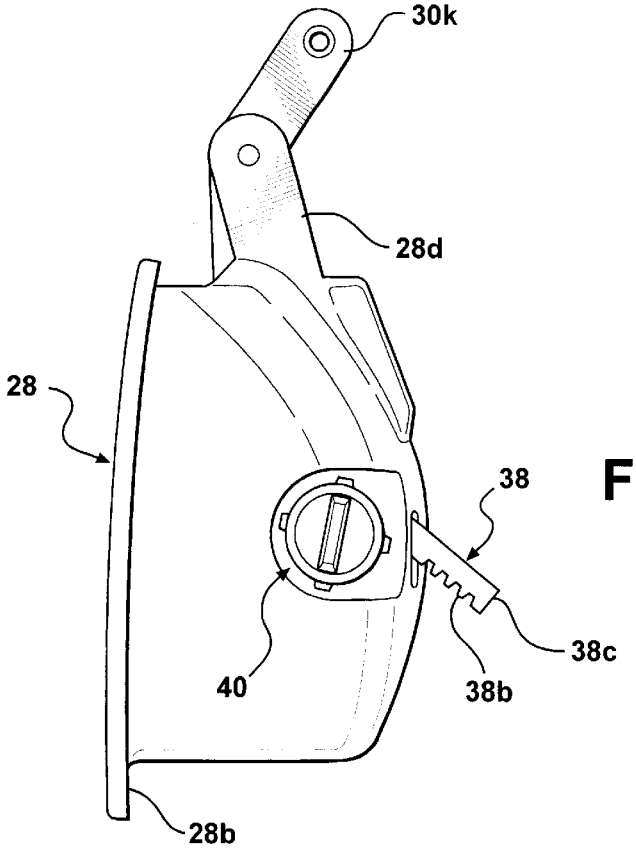
FIG. 4 is an end view of the door handle assembly.
Figure 5:
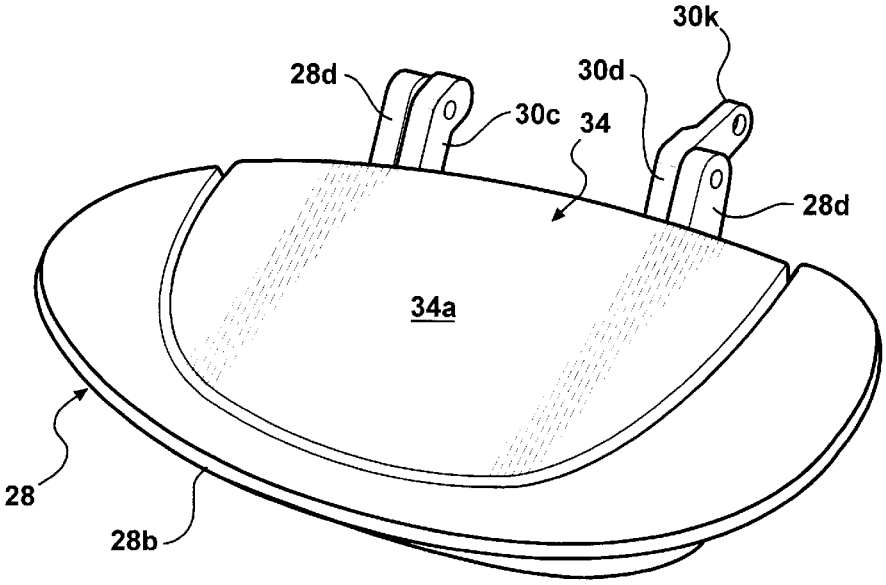
FIG. 5 is a front perspective view of the door handle assembly.
Figure 6:
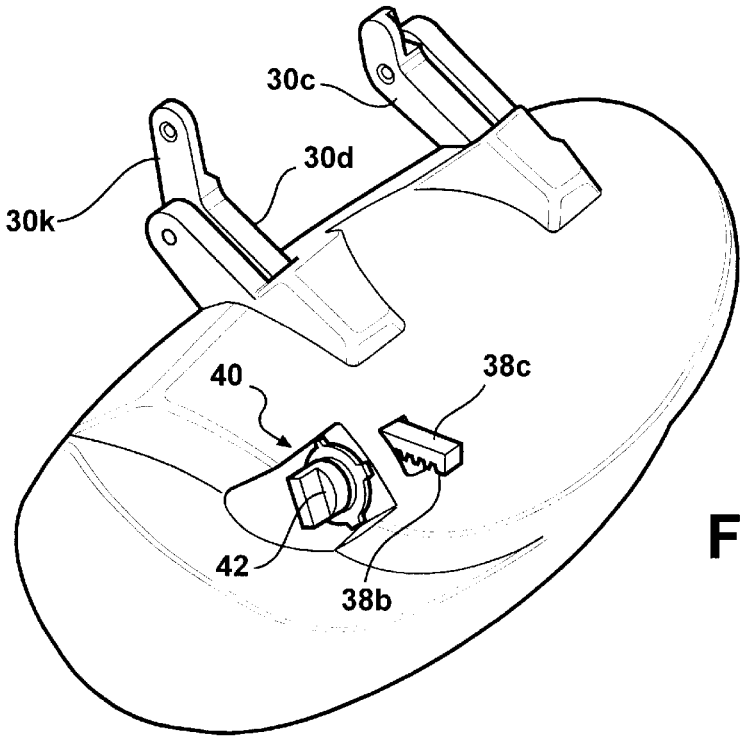
FIG. 6 is a rear perspective view of the door handle assembly.
Figure 7:
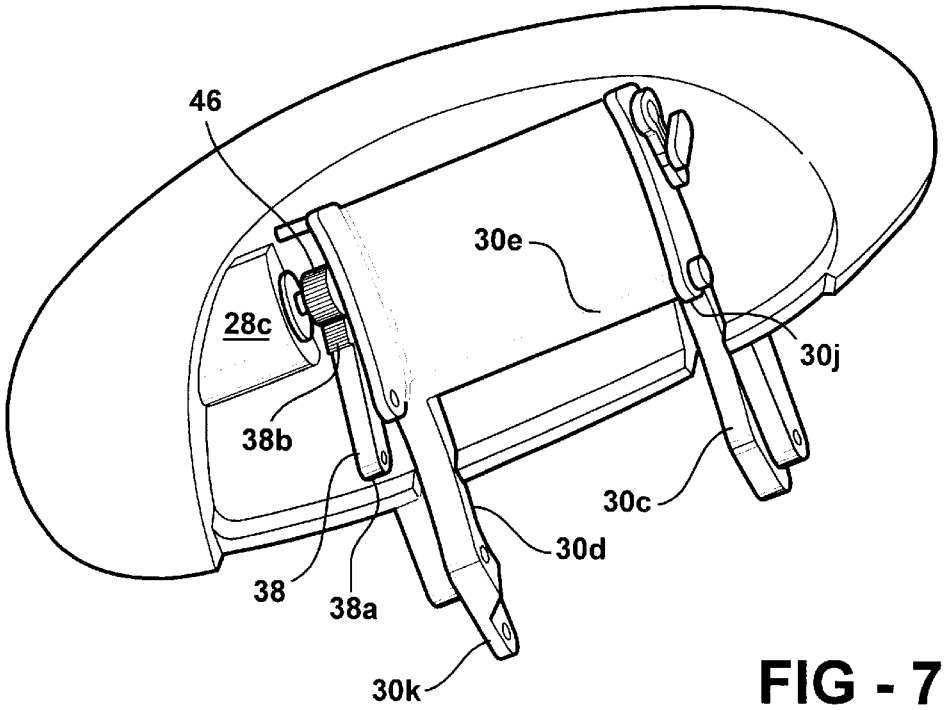
FIG. 7 is a further perspective view of the door handle assembly with a face plate of the assembly omitted for purposes of clarity.
Figure 8:
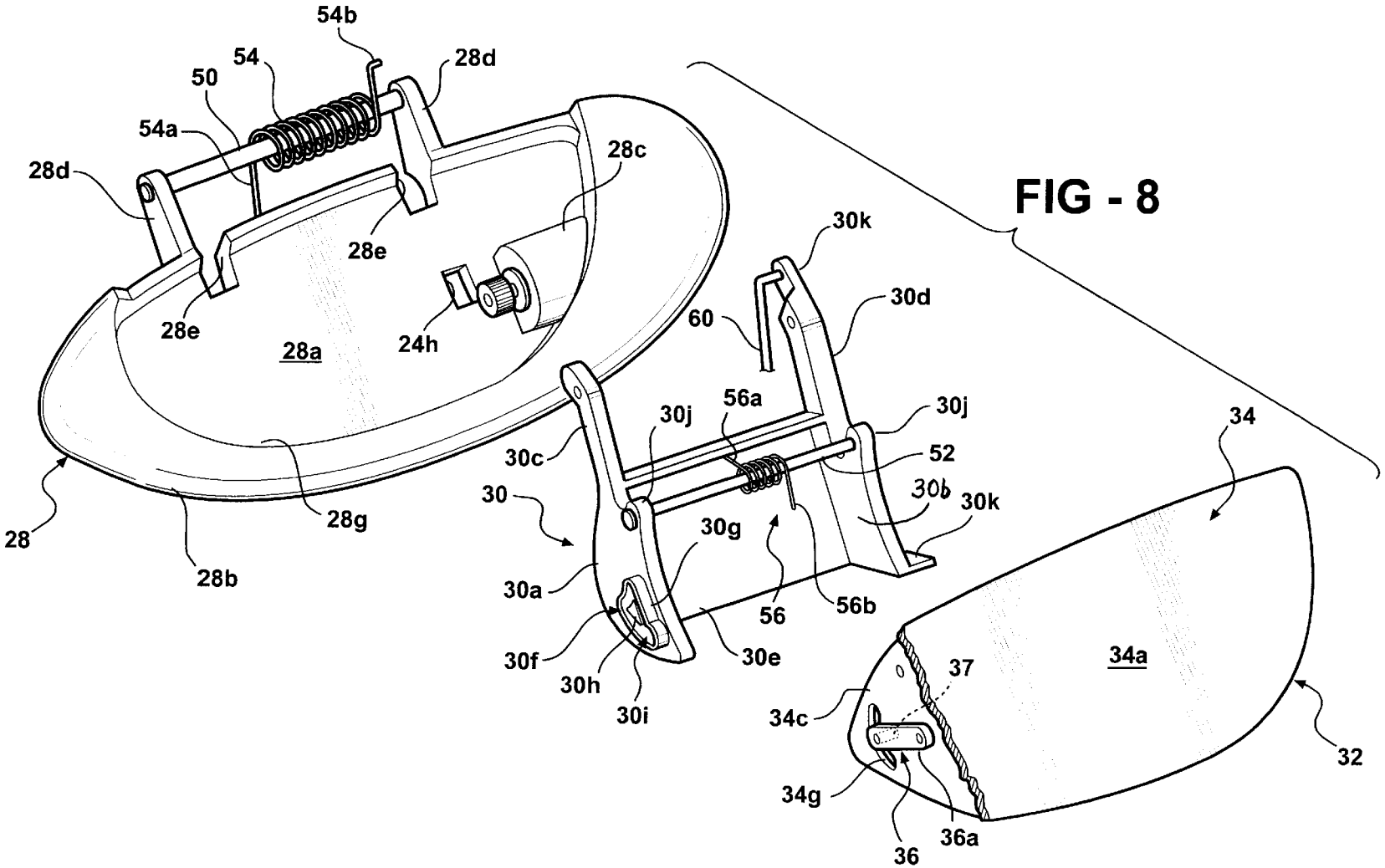
FIG. 8 is an exploded view of the door handle assembly.
Figure 9:
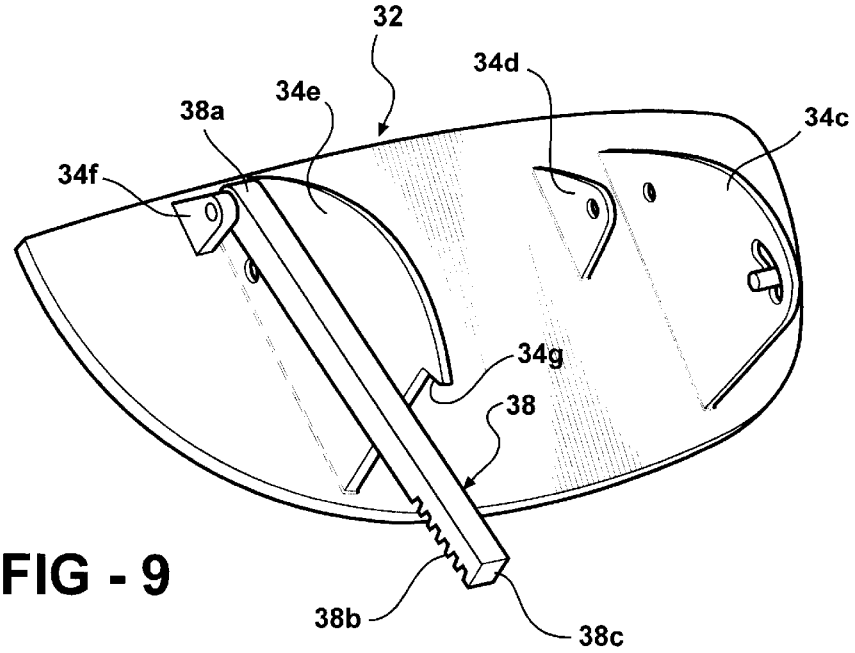
FIG. 9 is a perspective view of a face plate assembly utilized in the door handle assembly.

The invention door handle assembly 10 is seen in FIG. 1 in association with a fragmentarily shown motor vehicle 12, including a windshield 14, a front quarter panel 16, a hood 18, an A pillar 20, a sill 22, a B pillar 24 and a door 26 positioned in the door opening defined by the A pillar 20, front quarter panel 16, sill 22, and B pillar 24.

Door handle assembly 10, broadly considered, includes a housing or casing 28, a handle base member 30, and a face plate assembly 32, each of which may be formed in known manner of a suitable plastic or metallic material.

Casing 28 has an oval configuration and includes a central bowl portion 28*a*, a rim portion 28*b* surrounding the bowl portion, a damper housing structure 28*c* within the bowl portion, a pair of spaced posts or stanchions 28*d*, and a pair of slots 28*e* positioned inboard of the respective posts 28*d*. Rim 28*b* defines a central opening 28*g* in surrounding relation to the bowl portion.

Handle base member 30 includes a pair of spaced side plates 30*a* and 30*b*, an arm 30*c* formed as an upward and rearward extension of side plate 30*a*, an arm 30*d* formed as an upward and rearward extension of side plate 30*b*, a skirt 30*e* interconnecting side plates 30*a* and 30*b*, and a detent structure 30*f* formed on the outboard face of side plate 30*a*.

Detent structure 30*f* includes a closed loop rib 30*g* and an island 30*h* positioned within the rib and coacting with the rib to define a closed loop detent groove 30*i*.

Face plate assembly 32 includes a face plate 34, a detent link 36, a follower pin 37 mounted on the free end of link 36, and a rack 38.

Face plate 34 includes a generally planar main body portion 34*a* of generally oval configuration conforming generally to the size and configuration of the opening 28*g* defined by the rim 28*b* of the casing, and a plurality of spaced lugs 34*c*, 34*d*, 34*e* and 34*f* extending rearwardly from main body portion 34*a*.

Detent link 36 is pivotally mounted at a forward end 36*a* thereof on the outboard face of lug 34*c* with follower pin 37 extending through an arcuate guide slot 34*e* in lug 34*c* for receipt in detent groove 30*i*.

Rack 38 is pivotally mounted at a forward end 38*a* thereof between lugs 34*e* and 34*f* and includes a plurality of gear teeth 38*b* proximate the rear end 38*c* thereof.

Figure 14:
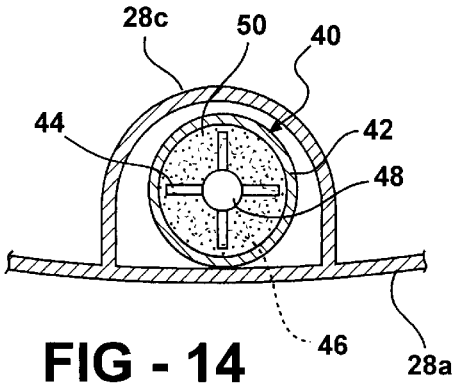

A damper assembly 40 (FIG. 14) is positioned in damper housing 28*c* of casing 28 and includes a cylindrical damper casing 42, a vane 44 mounted for rotary movement within casing 42, a damper pinion 46 mounted on the central shaft 48 of the vane 44 and positioned exteriorly of housing 28*c*, and a viscous fluid 50 filling the casing 42 in surrounding relation to vane 44 and providing shearing resistance to rotary movement of vane 44 within casing 42.

In the assembled relation of door handle assembly 10, handle base member 30 is positioned generally within the bowl portion 28*a* of casing 28 with arms 30*c* and 30*d* extending upwardly and rearwardly through slots 28*e* and pivotally mounted at their upper end on a pivot shaft 50 extending between posts 28*d* of the casing; face plate 32 is pivotally mounted on handle base member 30 by a pivot shaft 52 mounted on ear portions 30*j* formed as forward extensions of the side plates 30*a* and 30*b* and extending through suitable aligned apertures in lugs 34*c*, 34*d* and 34*e*; rack 38 extends rearwardly in overlying proximity to damper pinion 46 with the rear end 38*c* of the rack extending through a suitable aperture 28*h* in the bowl portion 28*a* of the casing and gear teeth 38*c* positioned immediately rearwardly of pinion damper 46; a primary coil return spring 54 positioned on shaft 50 bears at one end 54*a* against the bowl portion 28*a* of casing 28 and at its other end 54*b* against the upper end 30*k* of arm 30*d* so as to yieldably resists upward pivotal movement of handle base member 30 about the axis of pivot shaft 50; and a secondary detent coil spring 56 positioned on shaft 52 bears at one end 56*a* against the skirt portion 30*e* of handle base member 30 and at another end 56*b* against face plate 32 so as to urge the face plate for pivotal movement upwardly away from the handle base member.

Figure 13:
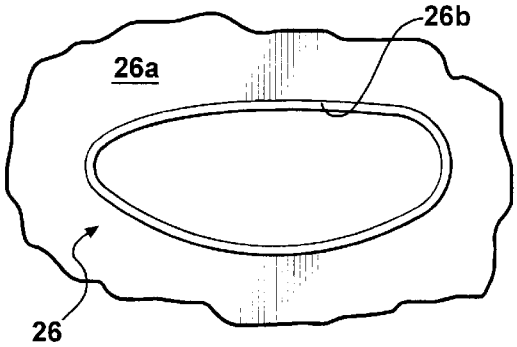
FIGS. 13, 14 and 15 are fragmentary detail views of the door handle assembly.

Handle assembly 10 is mounted in door 26 by positioning the assembly in an aperture 26*b* (FIG. 13) in the outer skin or panel 26*a* of the door and suitably securing the flange portion 28*b* of the casing to an outer face of the skin 26*a* with the handle assembly positioned inwardly of the door skin 26*a* and the outer face of the flange portion flush with outer skin 26*a*. An actuator link 60 is connected to the upper free end of arm 30*k* of the handle base member so that pivotal movement of the handle base member 30 about the axis of the shaft 50 has the effect, in known manner, of moving the latch mechanism 62 on the door 26 between latch and unlatch positions.

Figure 10:
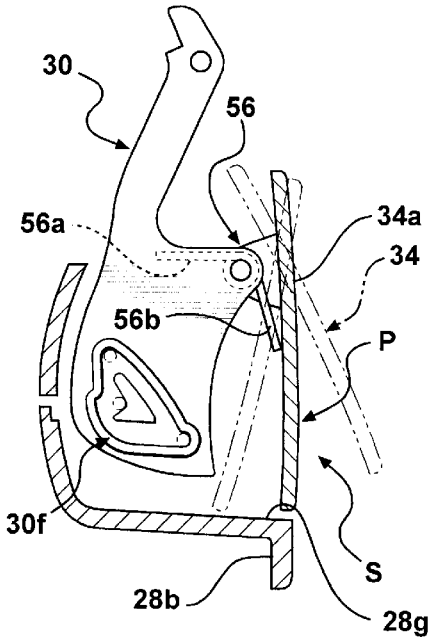
FIGS. 10, 11 and 12 are schematic cross-sectional views illustrating the operation of the door handle assembly.
Figure 11:
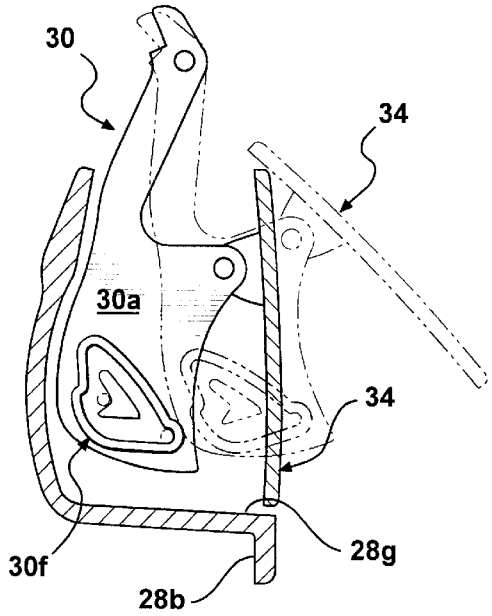
Figure 12:
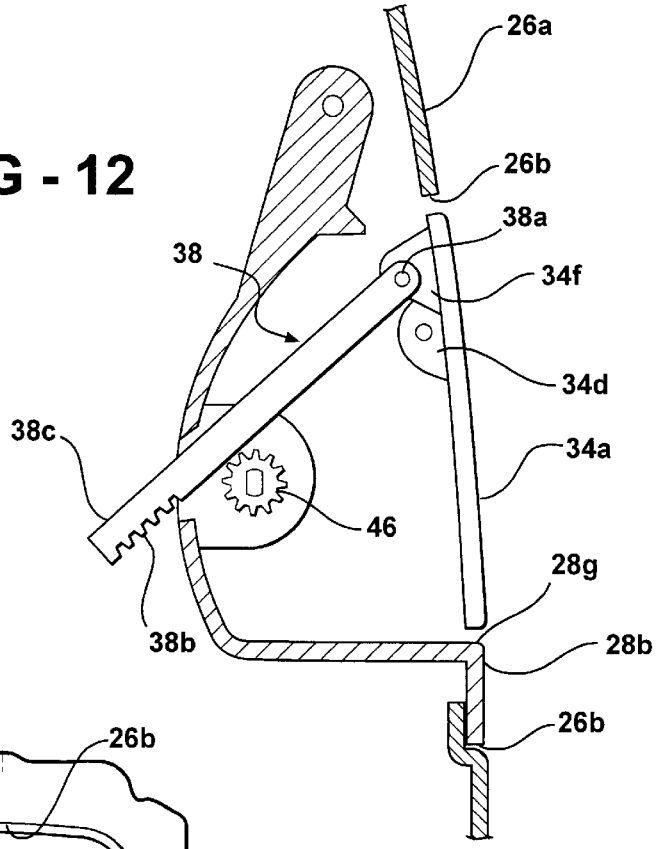

Face plate 34*a* is mounted on handle base member 30 for pivotal movement about the axis of shaft 52 between a flush position (seen in solid lines in FIG. 10) in which the face plate is positioned within and substantially fills the opening 28*g* defined by the casing flange 28; a grip position (seen in dash lines in FIG. 10) in which the face plate is pivoted outwardly and upwardly with respect to the handle base member to define a finger access space S between the face plate and the flange portion 28*b* of the casing; and a release position (seen in chain lines in FIG. 10) in which the face plate is moved inwardly with respect to the flange portion of the casing. The movement of the face plate between its flush, grip, and release positions is accompanied and defined (FIG. 15) by movement of the follower pin 37 in the closed loop groove 30*i* of detent 30*f*.

Figure 15:
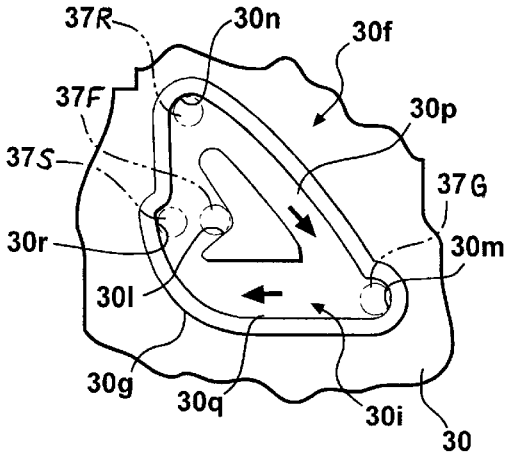

Specifically, with the face plate in its flush position, the follower pin 37 is in the position indicated by reference numeral 37F in FIG. 15 wherein the pin is received in a niche 301 defined at the rearward end of the island 30*h*. With the face plate in the grip position, as shown by the reference character 37G, the follower pin is received in a niche 34*m* defined at the forward end of the rib 30*g*. With the face plate in the release position, the follower pin 37, as shown by the reference character 37R, is positioned in a niche 30*n* defined by rib 30*g* upwardly and rearwardly of niche 301.

OPERATION

With the door in the closed and latched position and the face plate in the flush position, the handle assembly presents a smooth, clean, flush surface. Specifically, the outer surface of the flush plate is flush with the outer surface of the flange of the casing which in turn is flush with the outer surface of the outer skin or panel 26 of the door whereby to present an aesthetically pleasing appearance, minimize the wind resistence generated by the handle assembly during movement of the vehicle, and minimize whistling noises generated by the handle assembly.

When it is desired to open the door, the operator exerts a force P on the lower portion of the face plate to pivot the face plate inwardly or rearwardly about the axis of pivot shaft 52. This inward pivotal movement acts via follower link 36 to move follower finger 37 upwardly and rearwardly into position 37R in niche 30*n*. Upon release of the face plate by the operator, secondary detent spring 56 acts to pivot the face plate upwardly and forwardly about the axis of shaft 52. As the face plate pivots forwardly, follower link 36 moves follower pin 37 forwardly in the upper run 30*p* of the detent loop. As the face plate moves forwardly, it passes through the flush position of the face plate and moves to the grip position of the face plate as defined by arrival of the follower pin 37 at the position 37G within the niche 30*m*. Simultaneous with the arrival of the follower pin in niche 30*m*, a stop structure 34*g* on face plate lug 34*e* engages a co-acting stop structure 30*k* on handle base member side plate 30*b* to further define the grip position of the stop plate and further couple the face plate to the handle base member.

A space S has now been defined between the lower edge of the face plate and the adjacent rim portion of the casing to allow access by the operator's fingers. During the movement of the face plate on the handle base member between the flush, release, and grip positions, the gear teeth 38*c* on the rack 38 are not in engagement with damper pinion 46. The operator now inserts his fingers under the face plate into the space S and pulls upwardly and outwardly on the face plate. This has the effect, via the seating of the follower pin in niche 30*m* and the co-action of the stop structures 30*k* and 34*g*, of pivoting the handle base member 30 upwardly and outwardly about the axis of pivot shaft 50 to move the handle base member from a latch to an unlatch position whereby to unlatch the door latch 62 via the link 60.

As the face plate and handle base member are pivoted upwardly to unlatch the door, the teeth 38*c* of rack 38 engage damper pinion 46 and return spring 54 is wound to yieldly resist the opening movement of the face plate. Following movement of the face plate to the unlatch position, the operator releases the face plate whereupon the primary spring 54 returns the handle base member to the latch position. As the handle base member moves toward the latch position, the rack teeth 38*c* engage the damper pinion 46 whereby to generate resistance to the movement of the rack 38 and thereby the face plate 34. The force of primary spring 54 is greater than the combined force of secondary spring 56 and the damper resistance, whereas the damper resistance is greater than the force of the secondary spring. Since the rack 38 is pivotally attached to the face plate above the axis of pivot shaft 52, when the face plate is released to allow the handle base member to return under the urging of the primary spring to the latch position, the damper resistance overcomes the force of the secondary spring which has the effect of pushing the top of the face plate over the pivot axis 52. Thus, as the handle base member returns to the latch position, the face plate pivots inwardly relative to the handle base member from the grip position and through the flush position.

This pivoting movement of the face plate on the handle base member is accompanied by movement of the follower pin 37 through the lower run 30*q* of the detent groove to the stop position seen at 37S wherein the pin is resting in a nest surface 30*r* positioned immediately rearwardly of niche 30*l*. Arrival of the follower pin at the position 37S determines and delimits the inward pivotal movement of the face plate on the handle base member and corresponds to a position of the face plate relative to the handle base member that is depressed inwardly with respect to the flange portion 28*b* of the casing, and corresponds generally to the release position of the face plate. As the handle base member arrives at its latch position, the rack teeth 38*c* disengage from damper pinion 46 whereupon secondary spring 56 unwinds to move the face plate back to the flush position with the follower pin 37 returning to the position 37F nesting in the niche 30*l*. The handle assembly has now been returned to the latch position and the face plate has been returned to a flush position relative to the flange portion of the casing and relative to the outer door panel 26.

The invention will be seen to provide a motor vehicle door handle assembly that is easy to operate and that presents a smooth, flush surface with respect to the outer door panel whereby to minimize wind resistance and wind noise and maximize handle aesthetics.

What is claimed is:

1. A door handle assembly for use with a motor vehicle door having a panel, the door handle assembly being operative to latch and unlatch a door latch associated with the vehicle door and comprising:

means defining an opening in the door panel;

a face plate sized to fit in and fill the opening;

a handle base member mounted on the door structure and moveable between door latch and door unlatch positions, the face plate being mounted on the handle base member for movement between a flush position in which an outer surface of the face plate presents substantially flush with the door panel and substantially fills the opening, and a grip position in which the face plate is displaced outwardly from the door panel and defines a finger access space between the face plate and the opening;

spring operated detent means operative in response to inward pressure applied to the face plate with the face plate in the flush position to move the face plate outwardly from the flush position to the grip position, the face plate being arranged to move the handle base member from its latch position to its unlatched position in response to further outward displacement of the face plate from the door panel with the face plate in the grip position; and means operative in response to release of the face plate following unlatching and opening of the door to return the face plate to its flush position.

2. A door handle assembly according to claim 1 wherein:

the mounting structure further mounts the face plate for inward movement relative to the door panel to a release position; and the spring operated detent means is operative in response to inward movement of the face plate to the release position to move the face plate outwardly through the flush position to the grip position.

3. A door handle assembly according to claim 1 wherein:

the handle base member is adapted to be pivotally mounted on the door proximate the opening for movement between its latch and unlatch positions; and the face plate is pivotally mounted on the handle base member for movement between its flush, grip, and release positions.

4. A door handle assembly according to claim 3 wherein:

the handle assembly further includes a casing adapted to be fitted into an aperture in the panel and including a rim portion defining the opening in the door panel; and the handle base member is pivotally mounted on the casing.

5. A door handle assembly for use with a motor vehicle door having a panel defining an aperture, the door handle assembly being operative to latch and unlatch a door latch associated with the vehicle door and comprising;

a casing adapted to be fitted into the panel aperture and having a rim portion having an outer surface presenting substantially flush with the panel with the casing fitted into the aperture and defining a handle opening within the rim portion;

a face plate sized to fit in and fill the handle opening;

a handle base member mounted on door structure and moveable between door latch and door unlatch positions, the face plate being mounted on the handle base member for movement between a flush position in which an outer surface of the face plate presents substantially flush with the casing rim portion outer surface, and thereby substantially flush with the door panel, and a grip position in which the handle is displaced outwardly from the casing rim portion and defines a finger access space between the face plate and the casing rim portion;

spring operated detent means operative in response to inward pressure applied to the face plate with the face place in the flush position to move the face plate outwardly from the flush position to the grip position, the face plate being arranged to move the handle base member from its latch position to its unlatched position in response to further outward displacement of the face plate from the door panel with the face plate in the grip position; and means operative in response to release of the face plate following unlatching and opening of the door to return the face plate to its flush position.

6. A door handle assembly according to claim 5 wherein:

the mounting structure further mounts the face plate for inward movement relative to the door panel to a release position; and the spring operated detent means is operative in response to inward movement of the face plate to the release position to move the face plate outwardly through the flush position to the grip position.

7. A door handle assembly according to claim 5 wherein:

the handle base member is pivotally mounted on the casing for movement between its latch and unlatch position; and the face plate is pivotally mounted on the handle base member for movement between its flush grip and release positions.

8. A door handle assembly for use with a motor vehicle door having a panel, the handle assembly being operative to latch and unlatch a door latch associated with the vehicle door and comprising:

means defining an opening in the door panel;

a handle base member adapted to be mounted on the door for movement between a latch position and an unlatch position;

a face plate sized to fit in and fill the door panel opening and mounted for movement on the handle base member, with the handle base member in its latch position, between a flush position in which an outer surface of the face plate presents substantially flush with the door panel and substantially fills the door panel opening and a grip position in which the face plate is displaced outwardly from the door panel and defines a finger access space between the face plate and the door panel opening;

spring operated detent means operative in response to inward pressure applied to the face plate with the face plate in the flush position to cause the face plate to pop outwardly from the flush position to the grip position;

means operative to move the handle base member from the latch position to the unlatch position in response to further outward displacement of the face plate from the door panel with the face plate in the grip position;

primary spring means yieldly resisting movement of the handle base member from the latch position to the unlatch position and operative to urge the handle base member from the unlatch position to the latch position; and restoring means operative in response to return movement of the handle base member from the unlatch position to the latch position to move the face plate on the handle base member from the grip position to the flush position.

9. A door handle assembly for use with a motor vehicle door having a panel defining an aperture, the handle assembly comprising:

a casing adapted to be fitted into the panel aperture and having a rim portion having an outer surface presenting substantially flush with the panel with the casing fitted into the aperture and defining a handle opening within the rim portion;

a handle base member pivotally mounted on the casing for movement between a latch position and an unlatch position;

a face plate sized to fit in and fill the door panel opening and pivotally mounted on the handle base member for movement, with the casing fitted into the panel aperture and the handle base member in its latch position, between a flush position in which an outer surface of the face plate presents substantially flush with the door panel and substantially fills the door panel opening and a grip position in which the face plate is displaced outwardly from the door panel and defines a finger access space between the face plate and the door panel opening;

pop out means operative in response to inward pressure applied to the face plate with the face plate in the flush position to move the face plate outwardly from the flush position to the grip position;

means operative to move the handle base member from the latch position to the unlatch position in response to further outward displacement of the face plate from the door panel with the face plate in the grip position;

primary spring means yieldly resisting movement of the handle base member from the latch position to the unlatch position and operative to urge the handle base member for return movement from the unlatch position to the latch position;

secondary spring means urging the face plate toward the grip position; and a damper assembly operative during the return movement of the handle base member to apply a resistive force to the face plate greater than and opposing the urging force of the secondary spring means whereby to move the face plate from the grip position to the flush position during the return movement of the handle base member.

10. A door handle assembly according to claim 9 wherein the damper assembly includes a damper having a damped pinion and a rack connected to the face plate and meshingly engagable with the pinion.

11. A door handle assembly according to claim 10 wherein:

the face plate is mounted on the handle base member for inward movement relative to the door panel to a further, release position;

the popout means is operative in response to inward movement of the face plate to the release position to move the face plate outwardly through the flush position to the grip position;

the damper assembly is operative during the return movement of the handle base member to move the face plate from the grip position inwardly through the flush position to a further, stop position; and the rack is arranged to disengage from the damper pinion following movement of the face plate to the release position and return movement of the handle base member to the latch position, whereby to allow the secondary spring means to move the face plate from the stop position to the flush position and thereby restore the face plate to its flush position within the door panel opening.

12. A door handle assembly according to claim 11 wherein:

the handle assembly further includes a detent means interconnecting the handle base member and the face plate; and the detent means is operative to normally maintain the face plate in its flush position against the urging of the secondary spring means;

allow movement of the face plate to the release position against the urging of the secondary spring means in response to inward pressure applied to the face plate with the face plate in the flush position;

allow the face plate to move forward from the release position to the grip position under the urging of the secondary spring means upon release of the inward pressure on the face plate;

allow movement of the handle base member from the latch position to the unlatch position against the urging of the primary spring means in response to outward movement of the face plate with the face late in the grip position;

allow movement of the face plate from the grip position to the stop position in response to the resistive force of the damper assembly upon return movement of the handle base member from the unlatch position to the latch position; and allow movement of the face plate from the stop position to the flush position under the urging of the secondary spring means upon disengagement of the rack from the damper pinion.

13. A door handle assembly according to claim 12 wherein the detent means comprises:

a link pivotally mounted at one end thereof on of said handle base member and face plate and including a follower pin on another end thereof; and a closed loop cam groove defined on the other of said handle base member and face plate receiving said follower pin and defining stations for said pin at circumferentially spaced points around the closed loop corresponding respectively to the release, flush, grip, and stop positions of the face plate on the handle base member.

14. A door handle assembly according to claim 13 wherein:

the link is pivotally mounted on the face plate; and the closed loop cam groove is defined on the handle base member.

15. A door handle assembly according to claim 14 wherein:

the damper is mounted on the casing;

the face plate is pivotally mounted on the handle base member; and the rack is pivotally connected at one end thereof to the face plate and defines rack teeth proximate another end thereof for meshing coaction with the damper pinion.

16. A door handle assembly for use with a motor vehicle door having a panel, the door handle assembly being operative to latch and unlatch a door latch associated with the vehicle door and comprising:

means defining an opening in the door panel;

a face plate sized to fit in and fill the opening;

a mounting structure mounting the face plate in the door panel for movement between a flush position in which an outer surface of the face plate presents substantially flush with the door panel and substantially fills the opening, and a grip position in which the face plate is displaced outwardly from the door panel and defines a finger access space between the face plate and the opening;

means operative in response to inward pressure applied to the face plate with the face plate in the flush position to move the face plate outwardly from the flush position to the grip position;

the mounting structure further mounting the face plate for inward movement relative to the door panel to a release position;

the operative means being operative in response to inward movement of the face plate to the release position to move the face plate outwardly through the flush position to the grip position;

the mounting structure comprising a handle base member adapted to be mounted for movement on the door between a door latch position and a door unlatch position;

the face plate being mounted on the handle base member for movement between its flush, grip, and release positions;

the face plate being arranged to move the handle base member from the door latch position to the door unlatch position in response to further outward displacement of the face plate from the door panel with the face plate in the grip position;

the operative means comprising spring means interconnecting the handle base member and the face plate and urging the face plate outwardly from the handle base member toward the grip position and detent means maintaining the face plate in its flush position and operative in response to inward pressure on the face plate to release the face plate for movement to the grip position under the urging of the spring means;

the door handle assembly further including means operative in response to release of the face plate following unlatching and opening of the vehicle door to return the face plate to its flush position.

17. A door handle assembly for use with a motor vehicle door having a panel defining an aperture, the door handle assembly being operative to latch and unlatch a door latch associated with the vehicle door and comprising;

a casing adapted to be fitted into the panel aperture and having a rim portion having an outer surface presenting substantially flush with the panel with the casing fitted into the aperture and defining a handle opening within the rim portion;

a face plate sized to fit in and fill the handle opening;

a mounting structure mounting the face plate in the door panel for movement between a flush position in which an outer surface of the face plate presents substantially flush with the casing rim portion outer surface, and thereby substantially flush with the door panel, and a grip position in which the handle is displaced outwardly from the casing rim portion and defines a finger access space between the face plate and the casing rim portion;

means operative in response to inward pressure applied to the face plate with the face place in the flush position to move the face plate outwardly from the flush position to the grip position;

the mounting structure further mounting the face plate for inward movement relative to the door panel to a release position;

the operative means being operative in response to inward movement of the face plate to the release position to move the face plate outwardly through the flush position to the grip position;

the mounting structure comprising a handle base member pivotally mounted on the casing for movement between a door latch position and a door unlatched position;

the face plate being pivotally mounted on the handle base member for movement between its flush, grip, and release position;

the face plate being arranged to move the handle base member from the door latch position to the door unlatch position in response to further outward displacement of the face plate from the door panel with the face plate in the grip position;

the operative means comprising spring means interconnecting the handle base member and the face plate and urging the face plate outwardly from the handle base member toward the grip position and detent means maintaining the face plate in its flush position and operative in response to inward pressure on the face plate to release the face plate for movement to the grip position under the urging of the spring means;

the door handle assembly further including means operative in response to release of the face plate following and unlatching an opening of the door to return the face plate to its flush position.

18. A door handle assembly for use with a motor vehicle door having a panel, the handle assembly comprising:

means defining an opening in the door panel;

a handle base member adapted to be mounted on the door for movement between a latch position and an unlatch position;

a face plate sized to fit in and fill the door panel opening and mounted for movement on the handle base member, with the handle base member in its latch position, between a flush position in which an outer surface of the face plate presents substantially flush with the door panel and substantially fills the door panel opening and a grip position in which the face plate is displaced outwardly from the door panel and defines a finger access space between the face plate and the door panel opening;

popout means operative in response to inward pressure applied to the face plate with the face plate in the flush position to move the face plate outwardly from the flush position to the grip position;

means operative to move the handle base member from the latch position to the unlatch position in response to further outward displacement of the face plate from the door panel with the face plate in the grip position;

primary spring means yieldly resisting movement of the handle base member from the latch position to the unlatch position and operative to urge the handle base member from the unlatch position to the latch position;

restoring means operative in response to return movement of the handle base member from the unlatch position to the latch position to move the face plate on the handle base member from the grip position to the flush position;

the handle assembly further including secondary spring means urging the face plate toward the grip position; and the restoring means including a damper assembly operative during the return movement of the handle base member to apply a resistive force to the face plate greater than and opposing the urging force of the secondary spring means whereby to move the face plate from the grip position to the flush position during the return movement of the handle base member.

19. A door handle assembly for use with a motor vehicle door having a panel, the handle assembly comprising:

means defining an opening in the door panel;

a handle base member adapted to be mounted on the door for movement between a latch position and an unlatch position;

a face plate sized to fit in and fill the door panel opening and mounted for movement on the handle base member, with the handle base member in its latch position, between a flush position in which an outer surface of the face plate presents substantially flush with the door panel and substantially fills the door panel opening and a grip position in which the face plate is displaced outwardly from the door panel and defines a finger access space between the face plate and the door panel opening;

popout means operative in response to inward pressure applied to the face plate with the face plate in the flush position to move the face plate outwardly from the flush position to the grip position;

means operative to move the handle base member from the latch position to the unlatch position in response to further outward displacement of the face plate from the door panel with the face plate in the grip position;

primary spring means yieldly resisting movement of the handle base member from the latch position to the unlatch position and operative to urge the handle base member from the unlatch position to the latch position;

restoring means operative in response to return movement of the handle base member from the unlatch position to the latch position to move the face plate on the handle base member from the grip position to the flush position;

the handle assembly further including secondary spring means urging the face plate toward the grip position; and the restoring means including a damper assembly operative during the return movement of the handle base member to apply a resistive force to the face plate greater than and opposing the urging force of the secondary spring means whereby to move the face plate from the grip position to the flush position during the return movement of the handle base member;

the damper assembly including a damper having a damper pinion and a rack connected to the face plate and meshing the engageable with the pinion.

20. A door handle assembly according to claim 19 wherein:

the face plate is mounted on the handle base member for inward movement relative to the door panel to a further, release position;

the popout means is operative in response to inward movement of the face plate to the release position to move the face plate outwardly through the flush position to the grip position;

the damper assembly is operative during the return movement of the handle base member to move the face plate from the grip position and inwardly through the flush position to a further, stop position; and the rack is arranged to disengage from the damper pinion following movement of the face plate to the stop position and return movement of the handle base member to the latch position, whereby to allow the secondary spring means to move the face plate from the stop position to the flush position and thereby restore the face plate to its flush position within the door panel opening.

21. A door handle assembly according to claim 20 wherein:

the handle assembly further includes detent means interconnecting the handle base member and the face plate; and the detent means is operative to normally maintain the face plate in its flush position against the urging of the secondary spring means;

allow movement of the face plate to the release position against the urging of the secondary spring means in response to inward pressure applied to the face plate with the face plate in the flush position;

allow the face plate to move from the release position to the grip position under the urging of the secondary spring means upon release of the inward pressure on the face plate;

allow movement of the handle base member from the latch position to the unlatch position against the urging of the primary spring means in response to outward movement of the face plate with the face plate in the grip position;

allow movement of the face plate from the grip position to the stop position in response to the resistive force of the damper assembly upon return movement of the handle base member from the unlatch position to the latch position; and allow movement of the face plate from the stop position to the flush position under the urging of the secondary spring means upon disengagement of the rack from the damper pinion.

22. A door handle assembly according to claim 21 wherein the detent means comprises:

a link pivotally mounted at one end thereof on one of said handle base member and face plate and including a follower pin on another end thereof; and a closed loop cam groove defined on the other of said handle base member and face plate receiving said follower pin and defining stations for said pin at circumferentially spaced points around the detent loop corresponding respectively to the release, flush and grip positions of the face plate on the handle base member.

23. A door handle assembly according to claim 22 wherein:

the link is pivotally mounted on the face plate; and the closed loop cam groove is defined on the handle base member.

24. A door handle assembly according to claim 19 wherein:

the handle assembly further includes a casing adapted to be fitted into an aperture in the door panel and including a rim portion defining the opening in the door panel; and the handle base member is pivotally mounted on the casing.

25. A door handle assembly according to claim 24 wherein:

the damper is mounted on the casing;

the face plate is pivotally mounted on the handle base member; and the rack is pivotally connected at one end thereof to the face plate and defines rack teeth proximate another end thereof for meshing coaction with the damper pinion.

* * * * *